US010342365B2

(12) United States Patent
Frost

(10) Patent No.: US 10,342,365 B2
(45) **Date of Patent: *Jul. 9, 2019**

(54) HUTCH SHELF

(71) Applicant: Vanguard Packaging, Inc., Kansas Ctiy, MO (US)

(72) Inventor: Jerry Ryan Frost, Kansas City, MO (US)

(73) Assignee: VANGUARD PACKAGING, INC., Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/960,338

(22) Filed: Apr. 23, 2018

(65) Prior Publication Data

US 2018/0235382 A1 Aug. 23, 2018

Related U.S. Application Data

(63) Continuation of application No. 13/955,865, filed on Jul. 31, 2013, now Pat. No. 9,949,579.

(60) Provisional application No. 61/677,966, filed on Jul. 31, 2012.

(51) Int. Cl.

| | |
|---|---|
| ***A47F 5/10*** | (2006.01) |
| ***A47B 47/06*** | (2006.01) |
| ***A47F 5/11*** | (2006.01) |

(52) U.S. Cl.

CPC ..... *A47F 5/116* (2013.01); *A47B 47/06* (2013.01); *A47B 2220/0086* (2013.01)

(58) Field of Classification Search

CPC ..... A47B 43/02; A47B 47/06; A47B 55/06; A47F 5/10; A47F 5/101; A47F 5/11; A47F 5/112; A47F 5/114; A47F 5/116; A47F 5/118; B65D 81/3848

USPC ..... 211/132.1, 135, 149; 312/259

See application file for complete search history.

(56) References Cited

U.S. PATENT DOCUMENTS 2,918,178 A * 12/1959 Leone ..... A47F 5/116 211/195
3,362,610 A * 1/1968 Van Dyke ..... B65D 5/4804 206/561
3,987,737 A * 10/1976 Smith ..... A47F 5/116 108/179

(Continued)

FOREIGN PATENT DOCUMENTS

DE 474400 * 4/1929
GB 1188834 * 7/1966

*Primary Examiner* — Joshua E Rodden

(74) *Attorney, Agent, or Firm* — Kutak Rock LLP; Bryan P. Stanley

(57) ABSTRACT

A corrugated hutch display with a main section including left and right side panels opposing a back panel and a bottom panel extending from the back panel. The display includes shelf members secured to the back panel. The shelf members include bottom tabs on either side of the shelf members that are capable of being secured to the left and right side panels to secure the shelf members to the main section. The hutch display is erected from a knockdown configuration by folding the side panels until they are not coplanar with the back panel; folding the bottom panel until a portion of the back panel is aligned with the left and right side panels; folding the shelf members such that they are not coplanar with the back panel; and mating the bottom tabs of the shelf members with the left and right side panels of the main section.

19 Claims, 3 Drawing Sheets

(56) References Cited

U.S. PATENT DOCUMENTS 4,506,790 A * 3/1985 Muscari ..... A47F 5/116 108/180
4,646,922 A * 3/1987 Smith ..... A47F 5/116 211/132.1
5,016,545 A * 5/1991 Robertson ..... A47F 7/281 108/102
5,145,244 A * 9/1992 Kersting ..... A47B 43/02 211/149
5,190,211 A * 3/1993 Stoddard ..... A47F 5/116 211/135
5,193,466 A * 3/1993 Eder ..... A47F 5/116 108/166
5,213,220 A * 5/1993 McBride ..... A47B 43/00 211/126.16
5,253,769 A * 10/1993 Vlastakis ..... A47F 5/112 211/126.16
5,301,800 A * 4/1994 Kenney ..... A47F 7/147 206/449
5,702,011 A * 12/1997 Carroll ..... A47B 47/042 108/180
5,706,959 A * 1/1998 Smith ..... A47F 5/0018 108/165
5,826,732 A * 10/1998 Ragsdale ..... A47F 5/116 211/149
6,068,140 A * 5/2000 Mangrum ..... A47F 5/116 108/107
6,126,254 A * 10/2000 Maglione ..... A47B 43/02 248/174
6,378,710 B1 * 4/2002 Grueneberg ..... A47F 5/116 211/132.1
6,715,623 B2 * 4/2004 Broerman ..... A47F 5/116 211/149
7,007,615 B2 * 3/2006 Grueneberg ..... A47B 43/02 108/165
7,252,200 B1 * 8/2007 Hester ..... A47F 5/116 211/126.16
2002/0108541 A1 * 8/2002 Grueneberg ..... A47B 43/02 108/115
2003/0160015 A1 * 8/2003 Broerman ..... A47F 5/116 211/149
2008/0030113 A1 * 2/2008 Vail ..... A47B 43/02 312/259
2008/0169340 A1 * 7/2008 Sheffer ..... A47F 5/116 229/120.32
2013/0213915 A1 * 8/2013 Pfeifer ..... A47F 5/11 211/135

* cited by examiner

HUTCH SHELF

RELATED APPLICATIONS

The present application is a continuation application of U.S. patent application Ser. No. 13/955,865 filed Jul. 31, 2013, now U.S. Pat. No. 9,949,579, which claims priority benefit, with regard to all common subject matter, of earlier-filed U.S. Provisional Patent Application No. 61/677,966, filed Jul. 31, 2012, and entitled "TRIFEED HUTCH SHELF." The identified earlier-filed provisional patent application is hereby incorporated by reference in its entirety into the present non-provisional application.

FIELD

Embodiments of the present invention relate generally to the field of point of purchase merchandise displays. More particularly, embodiments of the present invention relate to a corrugated, paperboard container or display that is manufactured in a fold and glue assembly process and that is traditionally provided to an end user in a collapsed or knockdown configuration for setup.

BACKGROUND

Corrugated containers or displays are made from pieces of flat paperboard stock material that are die cut into shapes that define various panels. The shapes are folded along predefined lines between the panels with at least one overlapping strip or panel that is glued, taped or otherwise affixed to another panel to form an enclosed boundary. The panels are folded and/or glued into place to become the walls of the container. The containers or displays are traditionally provided to product manufacturers and/or retailers in a collapsed or knock-down configuration for storage, handling and shipping. The manufacturer and/or retailers open the knockdown containers or displays and fold appropriately to utilize the assembled container for packing and displaying products therein.

The knockdown containers or displays are typically manufactured by feeding flat die cut sheets through a fold-and-glue machine. The fold-and-glue machine applies adhesive and folds over select panels so that the panels are in the knockdown configuration. One common knockdown container and/or display is a "hutch" style display. A "hutch" is typically used to display products to consumers at a retail point-of-sale location. It is desirable to minimize the time and effort necessary for retailers to assemble a container from its knockdown configuration. Thus, such container suppliers typically attempt to design containers that do not require separate discrete parts such as reinforcing inserts or dividers. However, in circumstances in which heavy products are being displayed in a "hutch" display, it is often necessary to utilize separate metal poles and/or corrugated support dividers to handle the load. This adds considerably to the assembly labor as well as material costs for the container.

An example of such a corrugated hutch display is shown and described in U.S. Pat. No. 7,703,864 (the '864 Patent"), the entire disclosure of which is incorporated herein by reference. However, in the '864 Patent does not provide reinforcement features and is not configured to handle heavy loads. Therefore, it would be beneficial to provide a "hutch" style display that can accommodate heavier product loads without requiring additional support members (such as metal poles or corrugated support dividers).

SUMMARY

Embodiments of the present invention include a corrugated hutch display comprising a main section including left and right side panels opposing a back panel and a bottom panel extending from the back panel. Each panel of the main section is separated from an adjacent panel via a fold line. The hutch display includes two or more shelf members secured to the back panel and presenting shelves for the hutch display. Further, each of the shelf members includes bottom tabs on either side of the shelf members and that extend downward from the shelf members. The bottom tabs are secured to the left and right side panels to secure the shelf members to the main section of the hutch display.

Embodiments of the present invention may also include a method of making a corrugated hutch display, with the method including forming a main section that includes left and right side panels opposing a back panel, and a bottom panel extending from the back panel; forming a fold line between each panel of the main section and an adjacent panel; and forming at least two shelf members that are capable of being secured to the back panel and that are operable to present shelves for the display, with each of the shelf members including bottom tabs on either side of the shelf members and extending down from the shelf members. As such, the bottom tabs are configured to be secured to the left and right side panels to maintain the shelf members in place.

Embodiments of the present invention additionally include a method of erecting a corrugated hutch display, with the method including providing the hutch display in a knockdown configuration, with the hutch display includes a main section having left and right side panels opposing a back panel, and a bottom panel extending from the back panel. The provided hutch display further includes one or more shelf members, with the shelf members including bottom tabs that extend down from left and right sides of the shelf members. The method further includes folding the left and right side panels until the side panels are not coplanar with the back panel; folding the bottom panel until a portion of the back panel is aligned with the left and right side panels; folding the shelf members such that the shelf members are not coplanar with the back panel; and mating the bottom tabs of the shelf members with the left and right side panels of the main section.

This summary is provided to introduce a selection of concepts in a simplified form that are further described below in the detailed description. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

BRIEF DESCRIPTION OF THE DRAWING FIGURES

Embodiments of the present invention are described in detail below with reference to the attached drawing figures, wherein.

Figure 1:
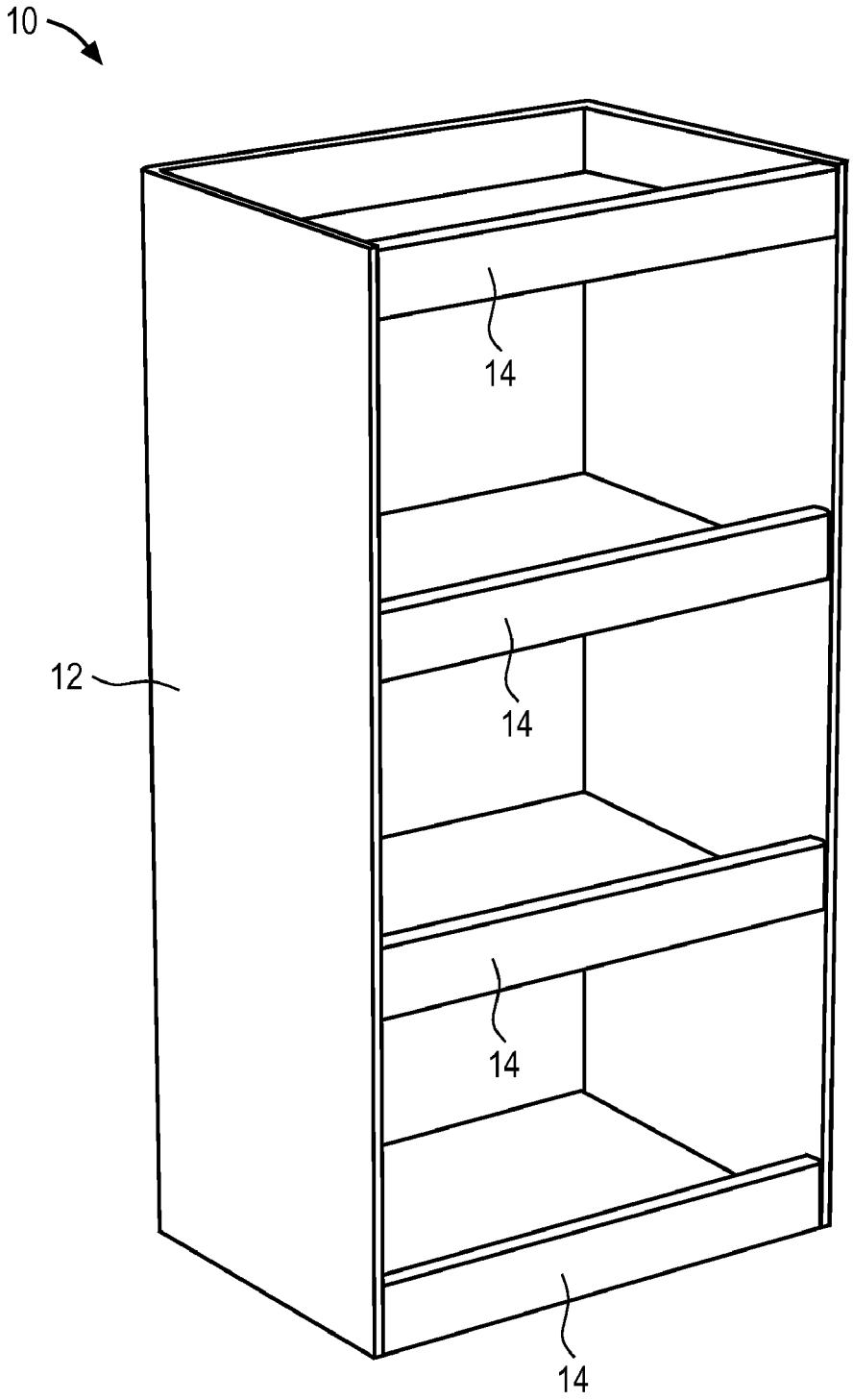
FIG. 1 is a perspective view of a hutch style display according to embodiments of the present invention.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE EMBODIMENTS

The following detailed description of the invention references the accompanying drawings that illustrate specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The following detailed description is, therefore, not to be taken in a limiting sense. The scope of the present invention is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be readily apparent to those skilled in the art from the description. For example, a feature, structure, act, etc. described in one embodiment may also be included in other embodiments, but is not necessarily included. Thus, the present technology can include a variety of combinations and/or integrations of the embodiments described herein.

As used herein, direction or relational terms such as "front," "back," "left," "right," "top," and "bottom" are used as an aid to the reader in place of less visual terms such as "first" and "second." Such terms are used in the context of a user viewing embodiments of the present invention from a front view. Similarly, the term "longitudinal" generally refers to an orientation or direction relative to an axis of elongation, whereas "lateral" refers to an orientation or direction that is generally perpendicular to the axis of elongation.

Figure 2:
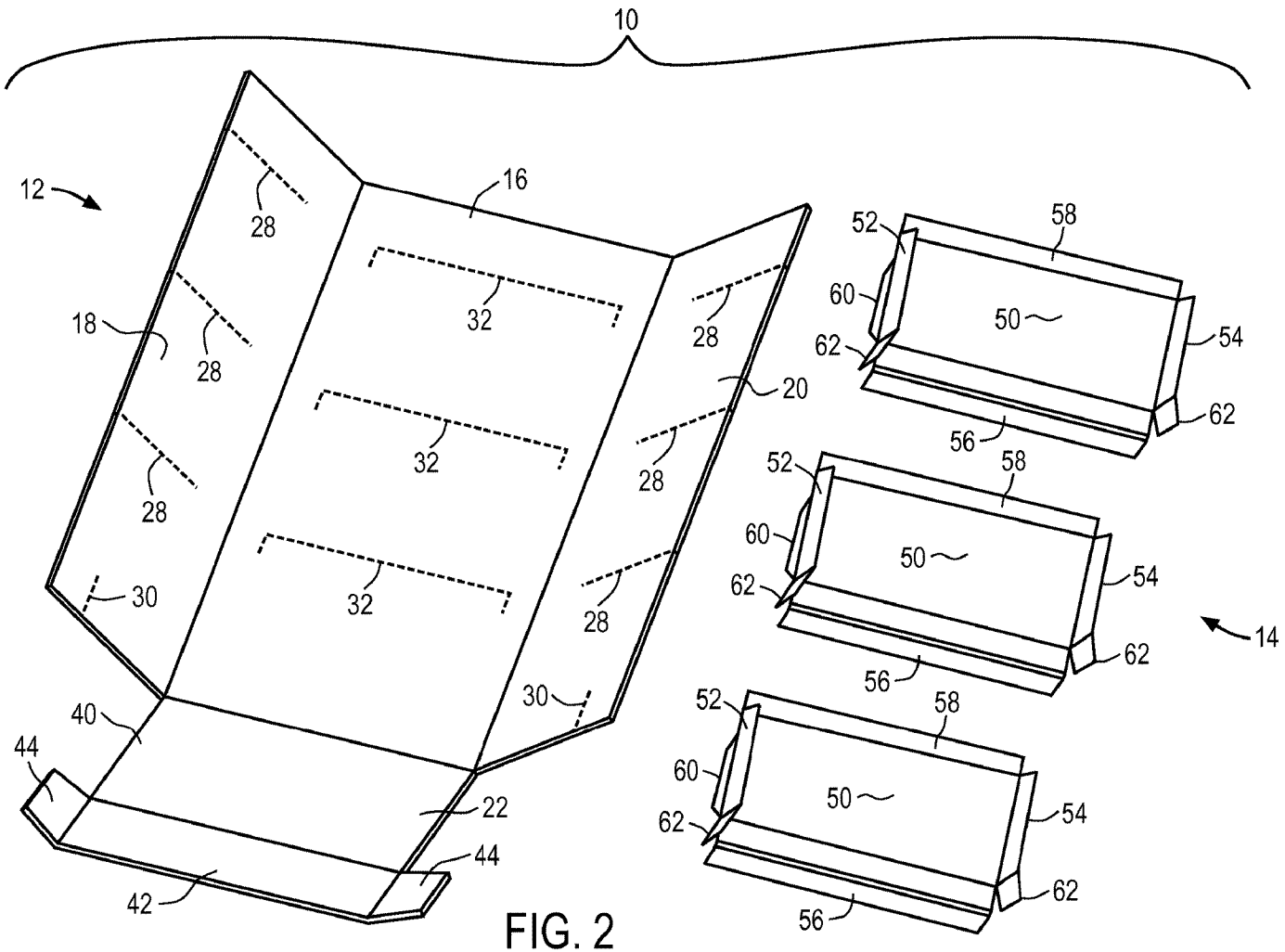
FIG. 2 is an exploded view of the hutch style display of FIG. 1.

As shown in FIG. 1, embodiments of the present invention include a hutch style display 10 that includes a main hutch section 12 and one or more shelf members 14 attached thereto for accommodating heavy product loads without the need for additional support members such as metal poles and corrugated dividers. In certain embodiments, the hutch style display 10 is formed from a corrugated material. In some embodiments, such corrugated material includes paperboard. However, other embodiments provides for the corrugated material to include other types of material, such as cardboard, fiberboard, or the like. In certain embodiments, the hutch style display 10 is capable of initially be produced in a knockdown form (i.e., a generally flat, two-dimensional form), such as illustrated in FIG. 2. From the knockdown form, embodiments provide for the the hutch style display 10 to be capable of transforming into an erected hutch style display, such as shown in FIG. 1. Remaining with FIG. 2, the main hutch section 12 of the hutch style display 10 of illustrated embodiments of the present invention comprises four main panels, including a back panel 16 opposed by left and right side panels 18,20, and a bottom panel 22 extending from the back panel. In some embodiments, each of the panels of the main hutch section 12 is formed from a single piece of corrugated material. As such, the main hutch section 12 in some embodiments is formed with fold lines thereon, which are weakened sections that provide for panels or portions of the hutch style display 10 to fold by any of various means. For example, certain embodiments provide for the corrugated material to be compressed along a thin line defining the fold line, or in other embodiments, cut part way through along the line, or cut all or part way through the line at spaced intervals.

Figure 3:
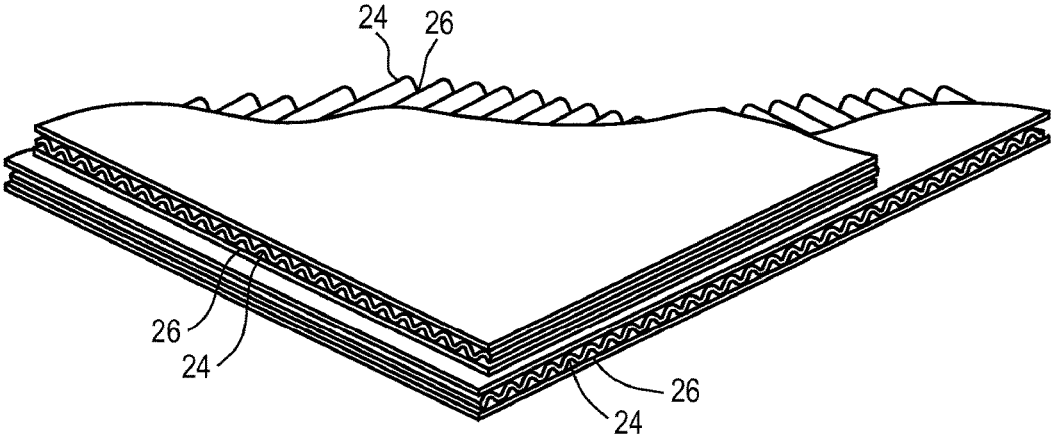
FIG. 3 is a partial view of a two pieces of corrugated material illustratively shown being secured together in a cross corrugated fashion.

In certain embodiments, one or more of the back panel 16, the left and right side panels 18,20, and/or the bottom panel 22 are formed from two or more pieces of corrugated paperboard material that are secured together, such as by glue, tape, or other similar adhesive. In certain embodiments, such pieces of corrugated paperboard material each generally comprise paperboard material having ridges and troughs that generally extend uniformly in a single direction across each individual piece. As illustrated in FIG. 3, certain embodiments provide for the two pieces of corrugated material to be secured together such that the directions of the ridges 24 and troughs 26 of the two pieces of corrugated paperboard material are generally oriented orthogonal to one another or otherwise at an angle other than parallel. Such non-parallel positioning of the ridges 24 and troughs 26 of the two pieces of corrugated paperboard material is hereinafter referred to as "cross corrugation." In certain embodiments, cross corrugation is provided to increase rigidity and strength of the panel(s) to which the cross corrugation is applied. In some embodiments in which the panels and/or sections of the hutch style display 10 (including portions of the shelf members 14) are cross corrugated, each of the pieces of corrugated paperboard material have fold lines positioned thereon, such that each the individual panels are formed from two pieces of cross corrugated material. In other embodiments, only certain panels of the hutch style display 10 are cross corrugated.

In some embodiments, each of the left and right side panels 18,20 of the main hutch section 10 include perforations in the form of horizontal slits 28 that are formed through the panels. In some embodiments in which the side panels 18,20 are cross corrugated, only an interior facing piece of corrugated material will include the horizontal slits 28 thereon. In certain embodiments, the horizontal slits 28 extend across an entire width of the side panels 18,20. However, in other embodiments, the horizontal slits 28 extend only across a portion of the width of the side panels 18,20. As will be discussed in more detail below, in some embodiments, the horizontal slits 28 are used to receive portions of the shelf members 14 so as to support the shelf members in position within the main hutch section 12. Additionally, in some embodiment, the left and right side panels 18,20 include perforations in the form of vertical slits 30 that are formed through the panels. In some embodiments in which the side panels 18,20 are cross corrugated, only the interior facing piece of corrugated material includes the vertical slits 30 thereon. In certain embodiments, the vertical slits 30 extend from a bottom portion of the side panels up a portion of a length of each of the side panels. As will be discussed in more detail below, the vertical slits 30 are used to receive portions of the bottom panel 22 so as to secure the bottom panel to the side panels 18,20.

Furthermore, in some embodiments, the back panel 16 includes perforations in the form of notches 32 that are formed through the back panel. In embodiments in which the back panel 16 is cross corrugated, each piece of corrugated material of the back panel will include the notches 32 therethrough. In certain embodiments, the notches extend across an entire width of the back panel 16. However, in other embodiments, the notches 32 extend across only a portion of the width of the back panel 16. As will be discussed in more detail below, in some embodiments, the notches 32 are used to receive portions of the shelf members 14 so as to support the shelf members in place as part of the hutch style display 10.

In some embodiments, the bottom panel 22 includes a main section 40 and a front lip 42 separated by a fold line, such that the front lip is operable to fold with respect to the main section. In certain embodiments, the bottom panel 22 includes side tabs 44 that extend from left and right sides of the front lip 42. Similarly, in some embodiments, the side tabs 44 are separated from the front lip 42 by fold lines, such that the side tabs are free to rotate or fold with respect to the front lip.

As illustrated by FIG. 2, the shelf members 14 each include a main section 50 opposed by left and right side sections 52,54 in a first direction and opposed by a front section 56 and a back section 58 in a second direction. As with the main hutch section 12, each of the sections of the shelf members 14 in some embodiment is formed from a single piece of corrugated material that has fold lines thereon, along which the segments of the shelf members are cable of folding by any of various means to form the individual sections. As such, each of the left and right side sections 52,54 and the front section 56 are capable of rotating or folding with respect to the main section 50. In certain embodiments, each of the sections of the shelf members 14 are formed from cross corrugated pieces of material, so as to increase the strength of the shelf member 14. However, in other embodiments, only certain sections, such as the main sections 50 of the shelf members 14 are cross corrugated.

In some embodiments, the left and right side sections 52,54 of each of the shelf members 14 include bottom tabs 60 that extend from below the main section 50 of the shelf member. As will be discussed in more detail below, the bottom tabs 60 in the embodiments shown is capable of being inserted into the horizontal slits 28 of the left and right side panels 18,20 of the main hutch section 12 to secure the shelf members 14 in place. In other embodiments one or more of the bottom tabs 60 are glued to the side panels 18,20 to secure the shelf members 14 in place. In additional embodiments, the shelf members 14 include the back section 58 located along a back side of the main section 50 of the shelf members. In certain embodiments, the back section 58 is positioned through the notches 32 of the back panel 16 so as to hold the shelf members 14 securely in place to the back panel. In certain other embodiments, the back section 58 is secured to the back panel 16 of the main hutch section 12 via an adhesive, such as glue, tape, or the like.

In some embodiments, the front section 56 of each of the shelf members 14 is formed as two individual sections that is capable of being folded and secured together to form shelf lips for each of the shelf members. In additional embodiments, the shelf members 14 include front tabs 62 that extend forward from each of the left and right side sections 52,54. As will be discussed in more detail below, in some embodiments, the front tabs 62 are positioned between the sections of the shelf lips of the front section 56, so as to secure the shelf members 14 together in a shelf-like configuration.

In operation, the hutch style display 10 is capable of being transformed in a quick and efficient manner from the knockdown configuration of FIG. 2 to the erected configuration of FIG. 1. To begin, the left and right side panels 18,20 of the main hutch section 12 are folded in along their fold lines until the side panels are generally parallel with each other and are generally perpendicular with the back panel 16. Next, the bottom panel 22 is folded in along its fold line until it is generally perpendicular with the back panel 16 and generally aligned with bottom portions of the side panels 18,20. Once the bottom panel is positioned as such, the front lip 42 of the bottom panel is folded until it is positioned generally perpendicularly with the main section 40 of the bottom panel 22. The bottom panel 22 is thereafter be secured in place by positioning the side tabs 44 of the bottom panel within the vertical slits 30 of the left and right side panels 18,20 of the main hutch section 12. In other embodiments, the side tabs 44 are secured to the side panels 18,20 via adhesive, such as glue, tape, or the like.

In some embodiments, upon the panels of the main hutch section 12 being folded in the positions described above, the shelf members 14 are folded and secured to the panels of the main hutch section. In particular, in some embodiments, the left and right side sections 52,54 of each of the shelf members 14 are folded such that the side sections are generally perpendicular with the main section 50 of the shelf member, and such that the bottom tabs 60 extend down below the main section. Similarly, in some embodiments, the two individual sections of the front section 56 are folded together and positioned perpendicularly with respect to the main section 50 to form the front lip. As such, the side tabs 62 of the left and right side sections 52,54 of the shelf members 14 are inserted between the individual sections of the front section 56 so as to secure the front section and the side sections together in place. In certain embodiments, the side tabs 62 are secured within the folded front section 56 by adhesive. In other embodiments, the side tabs 62 are held in place via frictional forces imparted onto the side tabs by the front section 56.

Once the shelf members 14 are positioned as such, each of the shelf members 14 is secured to the main hutch section 12 until the main section 50 of the shelf member is generally aligned perpendicularly with the back panel 16 of the main hutch section. In particular, in certain embodiments the bottom tabs 60 of the shelf members 14 are inserted within the horizontal slits 28 of the side panels of the main hutch section 12 to keep the shelf members 14 secured in place with respect to the main hutch section. Furthermore, some embodiments of the present invention provide for the back section 58 of the shelf members 14 to be secured to the back panel 16 of the main hutch section 12 with adhesive. However, in other embodiments, the back section 58 is secured to the back panel 16 by positioning the back section through the notches 32 formed in the back panel. As such, each the shelve members 14 of the hutch display 10 are capable of being quickly erected from their knockdown configuration (i.e., generally two-dimensional) and secured to the main hutch section 12. Furthermore, because some embodiments provide for portions of the hutch style display 10 to be formed from cross corrugated material, the hutch style display is operable to hold and support heavy loads.

In certain other embodiments, the main hutch section 12 includes a shelf raising panel (not shown) positioned on an interior facing surface of the back panel 16. The shelf raising panel is configured to translate upward and downward with respect to the back panel. In such embodiments, portions of the shelf members 14 are positioned through the shelf raising panel, such that when the shelf raising panel is translated upward, the shelf raising panel forces the shelf members upward to a position in which the bottom tabs 60 of the shelf members are capable of being inserted within horizontal slits 28 of the side panels 18,20. Similarly, with the bottom tabs 60 of the shelf members 14 unsecured within the horizontal slits 28 of the side panels 18,20, the shelf raising panel is capable of being translated downward, thus forcing the shelf members to lower down against the back panel 16. However, it is understood that embodiments of the present invention provide for the shelf members 14 to be raised and lowered manually, such the shelf raising panel is not required to be included with the hutch style display 10.

With the shelf members 14 secured in place, each of the shelf members presents a shelving area within which items may be securely positioned and displayed. Such shelving areas are bounded by the front section 56 of the shelf member 14, the side panels 18,20, and the back panel 16 of the main hutch section 12, so as to provide for a secure area within which such items may be positioned and stored. Furthermore, because portions of the hutch style display 10 are cross corrugated in some embodiments, and further because of certain features described above with respect to the hutch style display 10, each of the shelf members 14 is capable of holding and supporting items that comprise heavy loads.

Although the invention has been described with reference to the embodiments illustrated in the attached drawing figures, it is noted that equivalents may be employed and substitutions made herein without departing from the scope of the invention as recited in the claims. For instance, although the figures included herein illustrate a hutch style display 10 that has three shelf members 14 and a bottom panel 22 that holds and supports heavy load items, it is understood that embodiments of the present invention contemplate a hutch style display 10 having more than three shelf members by simply increasing the number of shelf members and/or increasing a size of the main hutch section.

Having thus described various embodiments of the invention, what is claimed as new and desired to be protected by Letters Patent includes the following:

1. A corrugated hutch display comprising:

a main section including a back panel, opposed left and right side panels extending from opposed side edges of said back panel, and a bottom panel extending from a bottom edge of said back panel, wherein each panel of said main section is separated from an adjacent panel via a fold line, wherein each of said left and right side panels include a perforation in the form of a vertical slit formed through a lower portion of said side panel, wherein said bottom panel includes side tabs extending from said bottom panel, wherein said side tabs are configured to be received by respective vertical slits of said left and right side panels, and wherein each vertical slit extends from a bottom edge of its respective left or right side panel.

2. The corrugated hutch display of claim 1, wherein the hutch display is formed from corrugated paperboard material.

3. The corrugated hutch display of claim 2, wherein one or more of said panels of said main section comprise at least two pieces of cross corrugated material.

4. The corrugated hutch display of claim 2, wherein said fold lines comprise compressed sections of the hutch display.

5. The corrugated hutch display of claim 1, further comprising a shelf member, portions of said shelf member comprising at least two pieces of cross corrugated material.

6. The corrugated hutch display of claim 5, wherein said left and right side panels of said main section define respective left and right horizontal slits, and wherein left and right bottom tabs of said shelf member are configured to be received by respective left and right horizontal slits.

7. The corrugated hutch display of claim 5, wherein said back panel of said main section defines a notch, and wherein a back tab of said shelf member is configured to be received by said notch.

8. The corrugated hutch display of claim 1, wherein each of said left and right side panels comprise opposed front and back edges, said back edge of each left and right side panel being coupled to a respective left or right edge of said back panel, wherein each vertical slit is positioned between said front and back edge of a respective left or right side panel such that each vertical slit is displaced from said front edge of its respective left or right side panel.

9. A method of making a corrugated hutch display, comprising:

forming a main section having a back panel, opposed left and right side panels extending from opposed side edges of the back panel, and a bottom panel extending from a bottom edge of the back panel;

forming a fold line between each adjacent panel of the main section; and forming side tabs extending from the bottom panel; and forming a vertical slit through each of the left and right side panels of the main section, wherein the side tabs are configured to be received by the vertical slits, and wherein each vertical slit extends from a bottom edge of its respective left or right side panel.

10. The method of claim 9, wherein the hutch display is formed from corrugated paperboard material.

11. The method of claim 10, wherein one or more of the panels of the main section are formed from two pieces of cross corrugated material.

12. The method claim 10, wherein the fold lines are formed by compressing portions of the hutch display.

13. The method of claim 9, further comprising forming a shelf member, portions of the shelf member being formed from two pieces of cross corrugated material.

14. The method claim 13, further comprising:

forming left and right horizontal slits in respective left and right side panels of the main section, wherein left and right bottom tabs of the shelf member are configured to be received by respective left and right horizontal slits.

15. The method claim 13, further comprising:

forming notch in the back panel of the main section, wherein a back tab of the shelf member is configured to be received by the notch.

16. The method of claim 9, wherein each of the left and right side panels comprise opposed front and back edges, the back edge of each left and right side panel being coupled to a respective left or right edge of the back panel, wherein each vertical slit is positioned between the front and back edge of a respective left or right side panel such that each vertical slit is displaced from the front edge of its respective left or right side panel.

17. A method of erecting a corrugated hutch display, comprising:

providing the hutch display in a knockdown configuration, wherein the hutch display includes a main section having a back panel, opposed left and right side panels extending from opposed side edges of said back panel, and a bottom panel extending from a bottom edge of said back panel, wherein each of the left and right side panels includes a perforation in the form of a vertical slit formed through a lower portion of the side panel, wherein the bottom panel includes side tabs extending from the bottom panel, and wherein the side tabs are configured to be received by respective vertical slits of the left and right side panels;

folding the left and right side panels until the side panels are not coplanar with the back panel;

folding the bottom panel until a portion of the bottom panel is aligned with the left and right side panels; and inserting the side tabs of the bottom panel into respective vertical slits, wherein each vertical slit extends from a bottom edge of its respective left or right side panel.

18. The method of claim 17, wherein each of the left and right side panels comprise opposed front and back edges, the back edge of each left and right side panel being coupled to a respective left or right edge of the back panel, and wherein each vertical slit is positioned between the front and back edge of its respective left or right side panel such that each vertical slit is displaced from the front edge of its respective left or right side panel.

19. The method of claim 18, wherein the left and right side panels of the main section define horizontal slits, the method further comprising inserting bottom tabs of a shelf member into respective horizontal slits.

* * * * *